US006177763B1

(12) United States Patent
Morrow

(10) Patent No.: US 6,177,763 B1
(45) Date of Patent: Jan. 23, 2001

(54) ELECTRODELESS LAMPS

(75) Inventor: William H. Morrow, Barrie (CA)

(73) Assignee: Resonance Limited, Ontario (CA)

( * ) Notice: Under 35 U.S.C. 154(b), the term of this patent shall be extended for 0 days.

(21) Appl. No.: 09/209,737

(22) Filed: Dec. 11, 1998

(30) Foreign Application Priority Data

Dec. 12, 1997 (CA) ..... 2224699

(51) Int. Cl.[7] ..... H01J 11/00
(52) U.S. Cl. ..... 313/607; 313/35; 313/36
(58) Field of Search ..... 313/607, 233, 313/634, 635, 234, 35, 36; 315/248, 344, 39

(56) References Cited

U.S. PATENT DOCUMENTS 4,837,484 * 6/1989 Eliasson et al. ..... 313/607
5,013,959 5/1991 Kogelschatz ..... 313/36
5,283,498 * 2/1994 Von Arx et al. ..... 313/607
5,866,991 * 2/1999 Farkas et al. ..... 313/153
5,932,960 * 7/1999 Terada et al. ..... 313/607

* cited by examiner

*Primary Examiner*—Nimeshkumar D. Patel
*Assistant Examiner*—Todd Reed Hopper
(74) *Attorney, Agent, or Firm*—David P. Gordon; David S. Jacobson; Thomas A. Gallagher

(57) ABSTRACT

An electrodeless lamp has a gas containing chamber with a first electrode and a second electrode, each surrounded by a dielectric, within the gas chamber and an AC source coupled between the first and second electrodes. In another aspect, the electrodeless lamp has a gas containing chamber with a dielectric chamber wall, a first electrode extending along the dielectric chamber wall outside of the gas containing chamber, a wound second electrode surrounded by a dielectric within the gas chamber, and an AC source coupled between the first and second electrodes.

21 Claims, 11 Drawing Sheets

ELECTRODELESS LAMPS

BACKGROUND OF THE INVENTION

A known class of lamps excites a gas causing it to break down to a light emitting plasma. The well-known fluorescent lamp falls into this class. With a fluorescent lamp, a direct current (DC) is applied to a pair of electrodes in a glass tube filled with a mixture of argon and mercury. Another type of lamp falling within this class is the electrodeless lamp. As discussed in, for example, U.S. Pat. No. 5,013,959 to Kogelschatz issued May 7, 1991, an electrodeless lamp may comprise a pair of concentric dielectric tubes. An electrode is disposed within the inner tube and another surrounds the outer tube; the gas is contained in the annulus between the tubes. An alternating current (AC) is applied to the electrodes to create an electric field in the gas thereby exciting the gas. This type of lamp is known as "electrodeless" because the electrodes do not contact the gas.

Electrodeless lamps may be filled with gas which emits in the UV spectrum. In such case, the lamp will be arranged to direct light to a treatment chamber so as to treat material in the chamber with UV light.

It is desirable to maximize the light generated by the lamp, however, the outer electrode may block some light from leaving the lamp. It is also desirable to maximize lamp life, however, the high energy plasma ions may degrade the dielectric tubes.

This invention seeks to overcome drawbacks of known electrodeless lamps.

SUMMARY OF THE INVENTION

In accordance with the present invention, there is provided an electrodeless lamp, comprising: a gas containing chamber; a first electrode surrounded by a dielectric within said gas chamber; a second electrode surrounded by a dielectric within said gas chamber; an AC source coupled between said first and second electrodes.

In accordance with another aspect of the invention, there is provided an electrodeless lamp, comprising: a gas containing chamber having a dielectric chamber wall; a first electrode extending along said dielectric chamber wall outside of said gas containing chamber; a wound second electrode surrounded by a dielectric within said gas chamber; an AC source coupled between said first and second electrodes.

BRIEF DESCRIPTION OF THE DRAWINGS

In the figures which illustrate example embodiments of the invention.

DETAILED DESCRIPTION OF THE PREFERRED EMBODIMENTS

Figure 1:
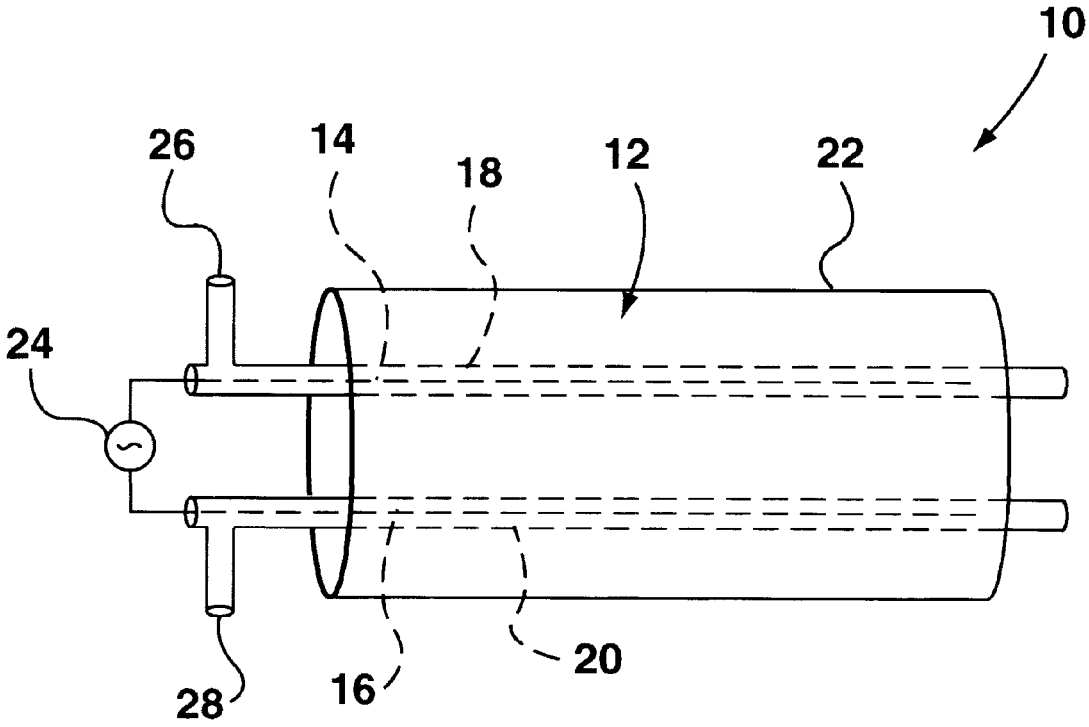
FIG. 1 is a schematic view of a lamp made in accordance with this invention.

With reference to FIG. 1, an electrodeless lamp 10 comprises a chamber 12 into which a first and second wire electrode 14, 16 extend. Each of the wire electrodes 14, 16 is surrounded by a tube 18, 20, respectively. At least one, and preferably each, of the tubes 18 and 20 is fabricated of a dielectric material, such as quartz. The wall 22 of the chamber 12 is sealed around tubes 18, 20 and the chamber is filled with gas. A alternating current (AC) source 24 is coupled between the first and second electrodes 14, 16. A cooling fluid may be injected into tubes 18 and 20 via ports 26, 28, respectively so as to flow through the tubes.

When the AC source 24 is energised, an oscillating charge of opposite polarity is imparted to electrodes 14 and 16; this causes the gas within chamber 12 to break down to plasma and emit light which passes through the wall 22 of chamber 12. The dielectric separating the electrodes prevents arcing between the electrodes.

Most of the energy released by the plasma is released as heat; cooling fluid may be ported through tubes 18 and 20 to remove excess heat from the chamber 12.

It will be apparent that lamp 10 avoids the need for an electrode on wall 22 of chamber 12. This, then, avoids the prospect of some of the light emitted by the lamp being blocked by such an electrode.

Figure 1A:
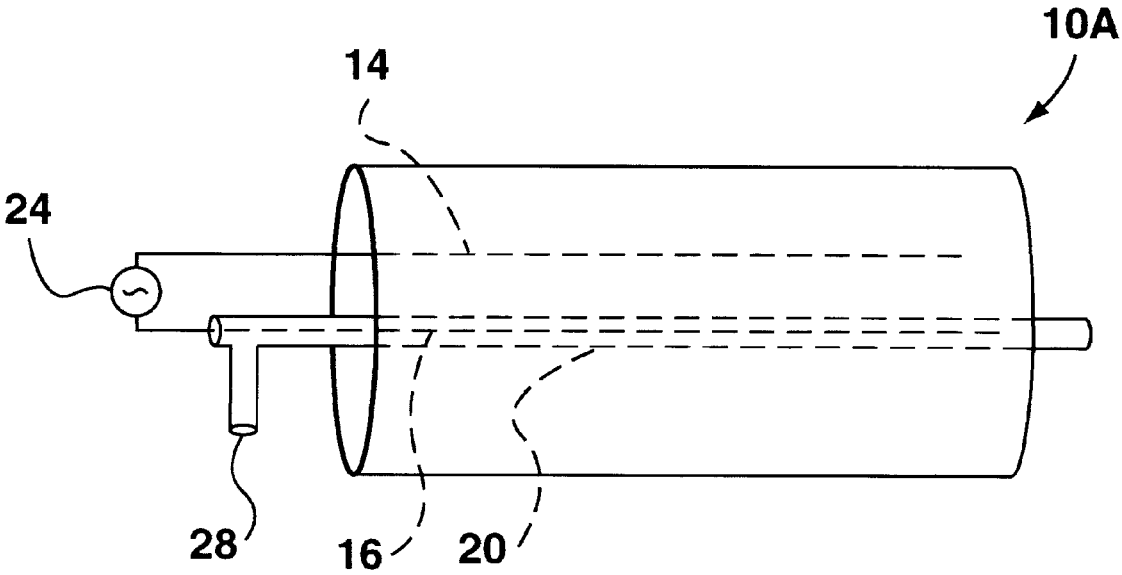
FIG. 1*a* is a schematic view of a lamp made in accordance with another aspect of this invention.

FIG. 1*a* illustrates a modified lamp 10*a* which is identical to lamp 10 of FIG. 1 except that dielectric tube 18 of FIG. 1 has been omitted. One dielectric tube, tube 20 is sufficient to prevent arcing between the electrodes. This construction has the advantage that the electrodes may be placed closer together than with the embodiment having two tubes which means that lamp 10*a* can have a stronger electric field between the electrodes. Nevertheless, this construction is generally not preferred because it is more difficult to construct a good seal about electrode 14 in the absence of a tube around it and, further, the metal of the electrode may be attacked by the plasma resulting in sputtering.

Figure 2:
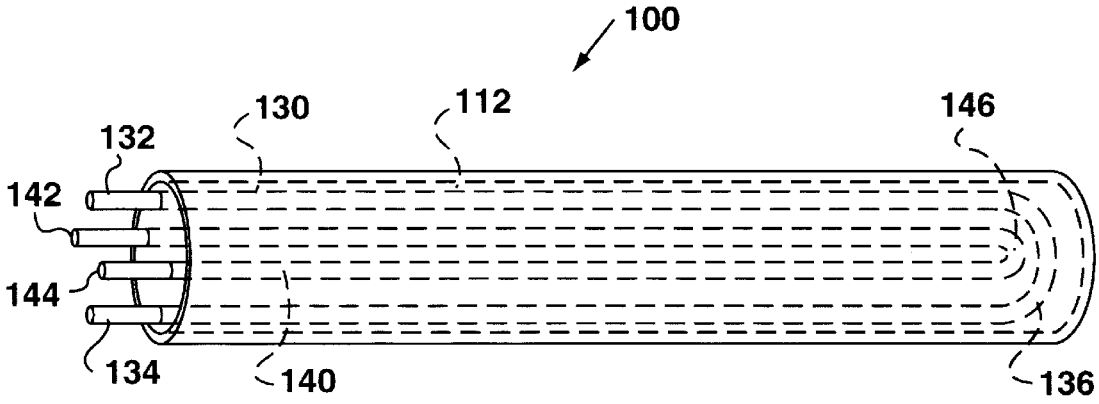
FIG. 2 is a perspective view of a portion of a lamp made in accordance with another aspect of this invention.
Figure 3:
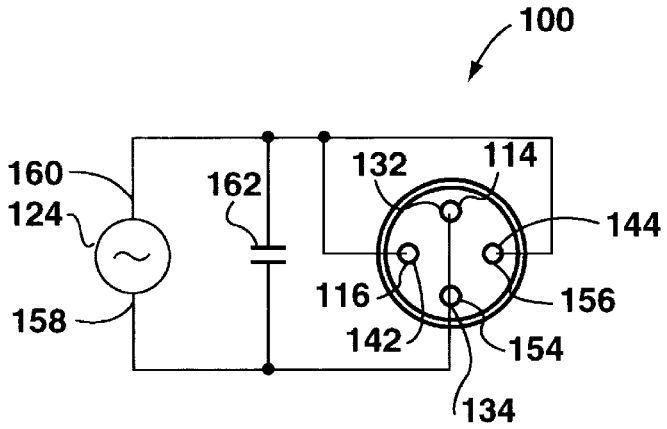
FIG. 3 is a schematic end view of the lamp of FIG. 2.

FIGS. 2 and 3 illustrate a modified lamp 100. Lamp 100 has a vertically oriented U-shaped dielectric tube 130 with an upper tube arm 132 and a lower tube arm 134 joined by a U-shaped section 136 and a horizontally oriented U-shaped dielectric tube 140 with a left side tube 142, a right side tube 144 joined by a U-shaped section 146. As seen in FIG. 3, a first electrode 114 is disposed within tube arm 132, a second electrode 116 disposed within tube arm 142, a third electrode 154 disposed within tube arm 134 and a fourth electrode 156 disposed within tube arm 144. None of the electrodes extend into the U-shaped sections 136, 146.

An AC source 124 is coupled, at one pole 158, to electrodes 114, 154 and, at the other pole 160, to electrodes 116, 156. A capacitor 162 is also connected between the poles 158, 160.

In operation, when AC source 124 is energised, electrodes 114, 154 are excited with one polarity and electrodes 116, 156 are excited with the opposite polarity to break down gas in chamber 112 to plasma. The capacitor 162 increases the length of time a greater potential is applied to the electrodes. Cooling fluid may be ported down one of tube arms 132, 134 and down one of tube arms 142, 144 and returned via the U-shaped tube sections 136, 146 through the other of tube arms 132, 134 and the other of tube arms 142, 144.

By doubling the number of electrodes in chamber 112 (as compared with chamber 12 of FIG. 1), a greater proportion of the gas in the chamber is exposed to a higher electric field. This increases the efficiency of the lamp.

By injecting and returning the cooling fluid through the same end of chamber wall 122, the opposite end of chamber wall 122 may be more simply sealed.

Figure 4:
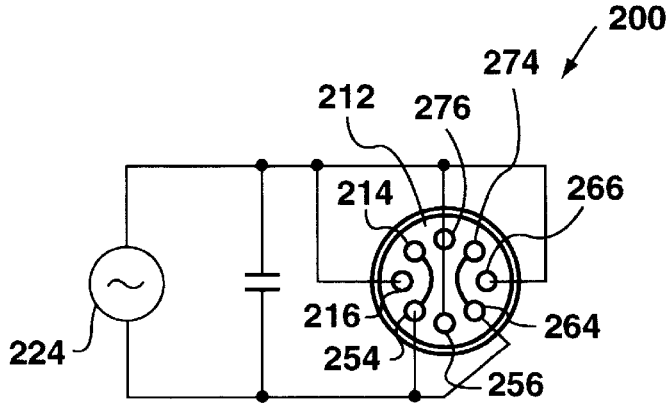
FIG. 4 is a schematic end view of a lamp in accordance with another aspect of this invention.

FIG. 4 illustrates a further modified lamp 200 with eight electrodes 214, 216, 254, 256, 264, 266, 274, 276, each disposed within one of eight dielectric tubes arranged about the periphery of a notional circle in chamber 212. The eight electrodes are coupled to AC source 224 and a capacitor 262 such that when the AC source is energised, circumferentially adjacent electrodes have opposite polarity. Lamp 200 thus operates in the same fashion as lamp 100 of FIGS. 3 and 3, however, an even greater proportion of the gas in the chamber 212 is exposed to a higher electric field.

Figure 5:
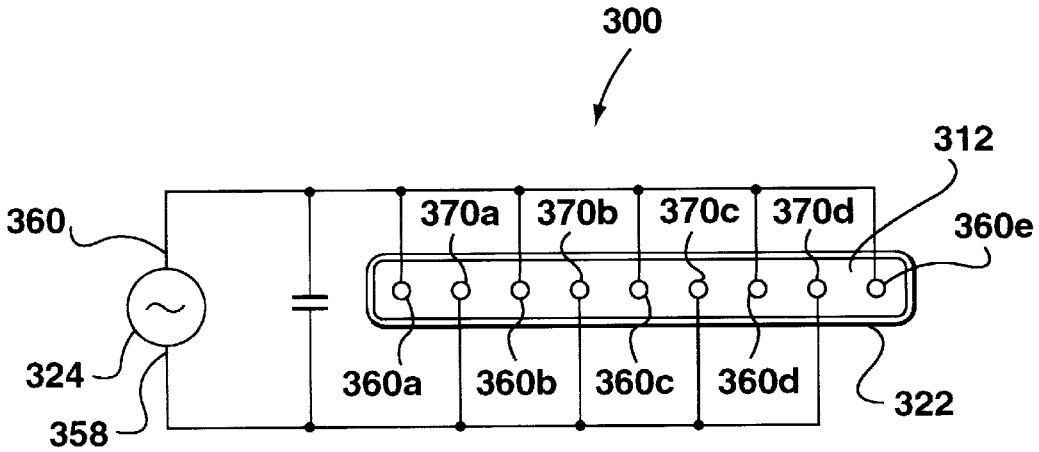
FIG. 5 is a schematic end view of a lamp in accordance with another aspect of this invention.
Figure 6:
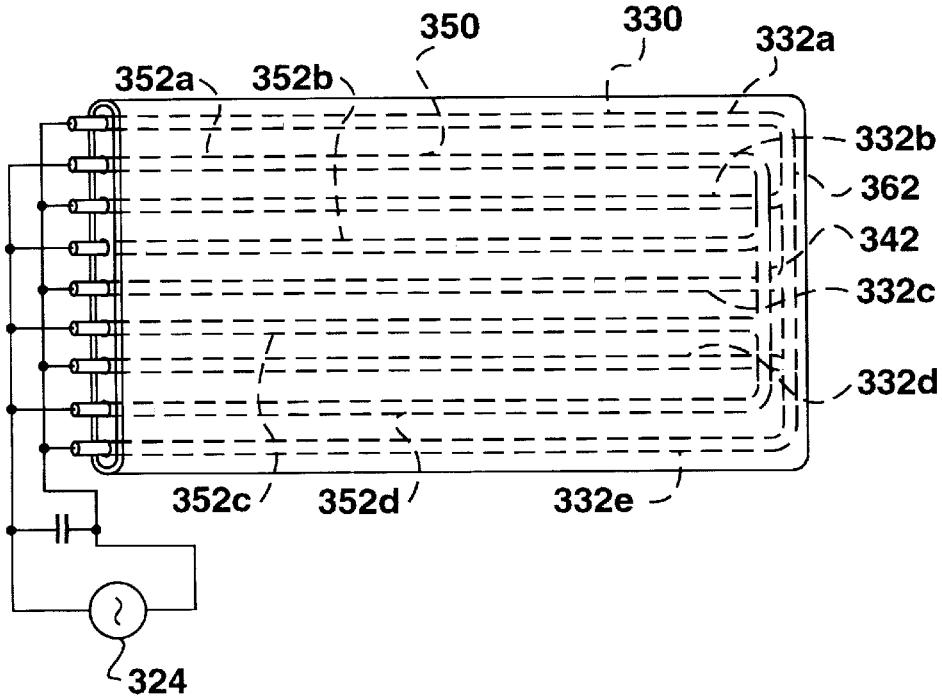
FIG. 6 is a schematic perspective view of the lamp of FIG. 5.

FIGS. 5 and 6 illustrate a further embodiment wherein chamber wall 322 of lamp 300 defines a generally rectangular chamber 312. A first comb-shaped tube network 330 comprises a series of five parallel tubes 332*a*, 332*b*, 332*c*, 332*d*, 332*e* joined by a basal tube 342. A second comb-shaped tube network 350 comprises a series of four parallel tubes 352*a*, 352*b*, 352*c*, 352*d* joined by a basal tube 362. An electrode 360*a*, 360*b*, 360*c*, 360*d*, 360*e*, extends along the interior of each of the five tubes of the first comb-shaped tube network 330 (but not into the basal tube 342 of the network) and is coupled to one pole 360 of AC source 324. An electrode 370*a*, 370*b*, 370*c*, 370*d*, extends along the interior of each of the four tubes of the second comb-shaped tube network 350 (but not into the basal tube 362 of the network) and is coupled to the other pole 358 of AC source 324. The comb networks 330, 350 are disposed such that all of the tubes are parallel and adjacent tubes hold electrodes connected to opposite poles of AC source 324.

Similarly to lamp 200 of FIG. 4, when AC source 324 is energised, an electric field is set up between adjacent electrodes which breaks down gas in chamber 312 to a light emitting plasma.

Figure 7:
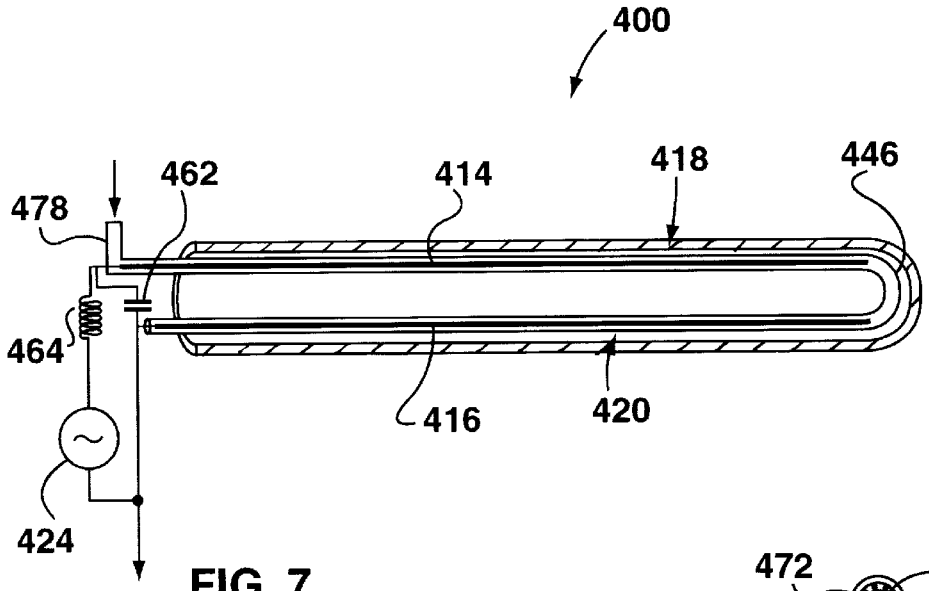
FIG. 7 is a schematic view of a lamp made in accordance with another aspect of this invention.
Figure 7A:
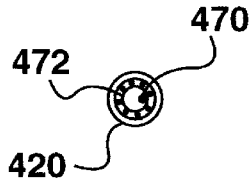

FIGS. 7 and 7*a* illustrates a lamp 400 similar to lamp 100 of FIG. 1 except that the parallel dielectric tubes 418, 420 are joined by a basal U-shaped section 446. Also, the electrode 414, 416 in each tube 418, 420 comprises a wire 470 abutting an electrically conductive coating 472 on the inside of the tube. The electrodes terminate at the U-shaped section 446. The AC source 424 includes a series inductor 464 and a parallel capacitor 462 which act as a resonant circuit to maximize the power coupled to the electrodes. In operating the lamp 400, cooling fluid may be injected through port 478 of tube 418 and returned along tube 420.

Figure 8:
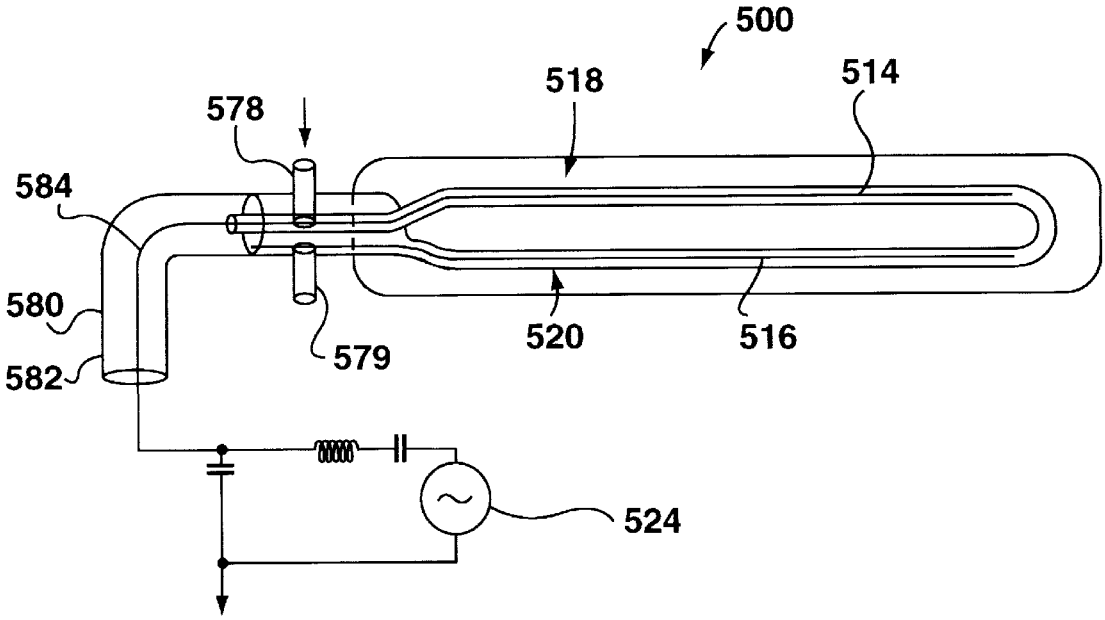
FIG. 8 is a schematic view of a lamp made in accordance with another aspect of this invention.

Lamp 500 of FIG. 8 is similar to lamp 400 of FIG. 7 except that a coaxial cable is used to connect the AC source to the electrodes. More particularly, the sheath 582 of coaxial cable 580 is connected between one pole of AC source 524 (ground) and electrode 516 of the lamp. The inner conductor 584 of the coaxial cable is connected between the other pole of the AC source and electrode 514. Port 578 provides a cooling fluid connection to tube 518 which houses electrode 514 and port 579 provides a cooling fluid connection to tube 520 which houses electrode 516.

Figure 9:
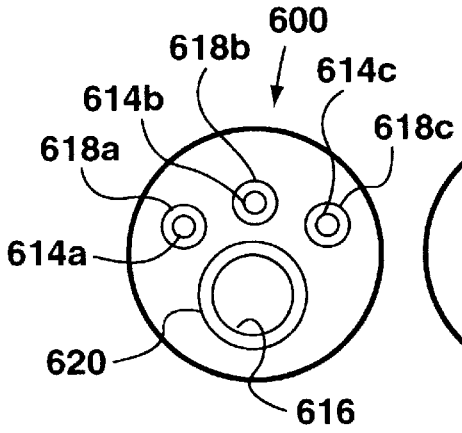
FIG. 9 is a schematic end view of a lamp made in accordance with another aspect of this invention.

FIG. 9 illustrates a lamp 600 with enlarged dielectric tube 620 coated on the inside with an electrically conductive film electrode 616 and three small dielectric tubes 618*a*, 618*b*, 618*c*, each coated on the inside with an electrically conductive film electrode 614*a*, 614*b*, 614*c*. The electrodes 614*a*, 614*b*, 614*c* are connected to one pole of an AC source and the electrode 616 is connected to an opposite pole of the AC source. The three tubes 6181, 618*b*, 618*c* may be joined at one end to the enlarged tube 620 for conducting cooling fluid in and out one end of the lamp.

Figure 10:
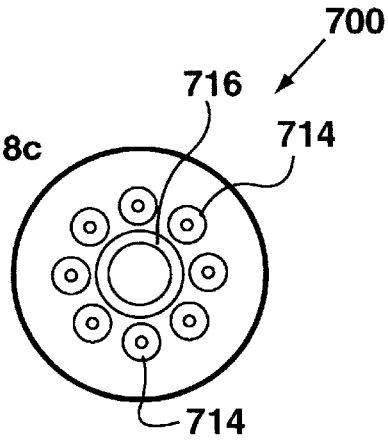
FIG. 10 is a schematic end view of a lamp made in accordance with another aspect of this invention, FIG. 11 a partially perspective, partially schematic view of a lamp made in accordance with an other aspect of this invention.

FIG. 10 illustrates a lamp 700 similar to lamp 600 of FIG. 9 except that the electrodes are arranged as a central electrode 716 and peripheral electrodes 714 arranged circumferentially around central electrode 716. The electrodes 714 are connected to one pole of an AC source and the electrode 716 is connected to an opposite pole of the AC source.

The multiple tubes of lamps 600 (FIG. 9) and 700 (FIG. 10) allow for better cooling due to the larger surface area of gas/cooling tube contact. Also, the plasma may be configured by appropriate placement of the tubes to be more concentrated in one area thereby allowing stronger illumination of a target.

Figure 11:
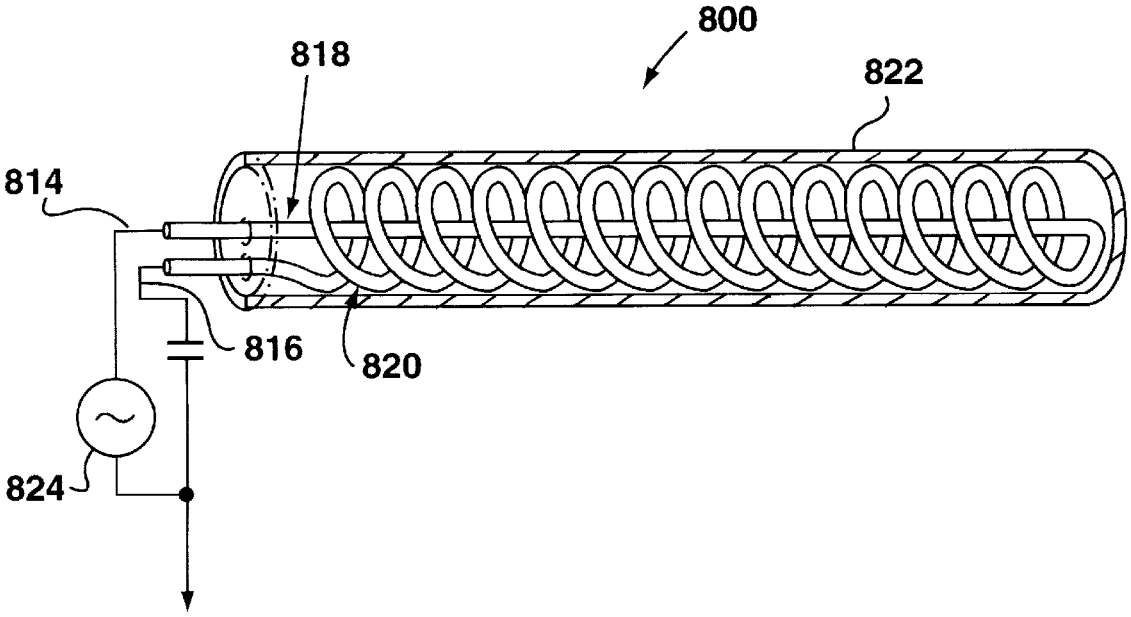

FIG. 11 illustrates a lamp 800 identical to lamp 400 of FIG. 7 except that dielectric tube 820 is formed as a helix around dielectric tube 818. Because of this, when AC source 824 is energised, the oscillating electric field between the electrodes 814, 816 establishes a magnetic field with flux lines parallel to the axis of the helical tube 820. This magnetic field reduces the number of ions in the plasma resulting from the excitation which will embed in wall 822 of the lamp. Reducing ion bombardment increases the life of the lamp.

Figure 12A:
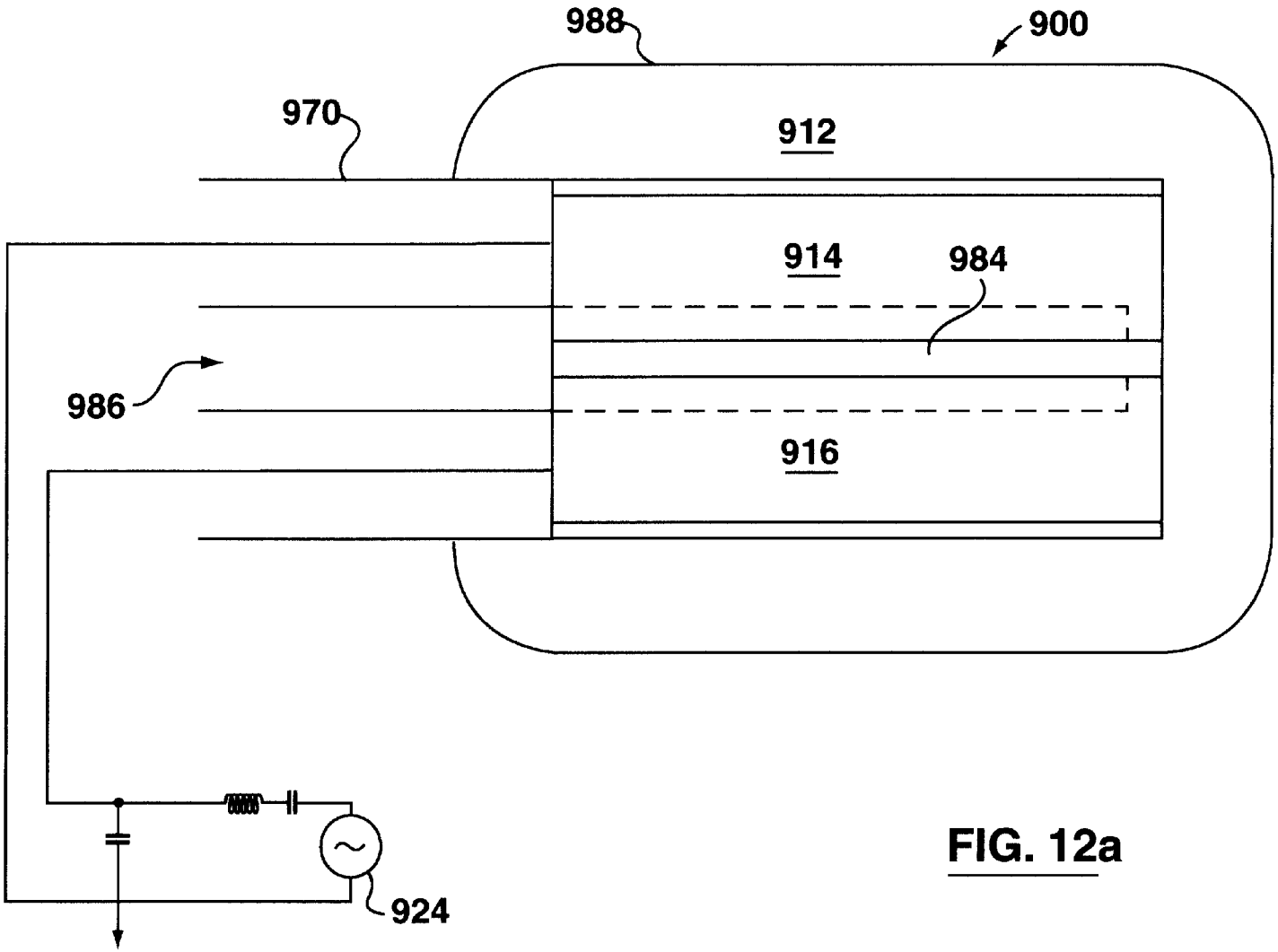
FIG. 12*a* is a schematic side view of a lamp made in accordance with another aspect of this invention.
Figure 12B:
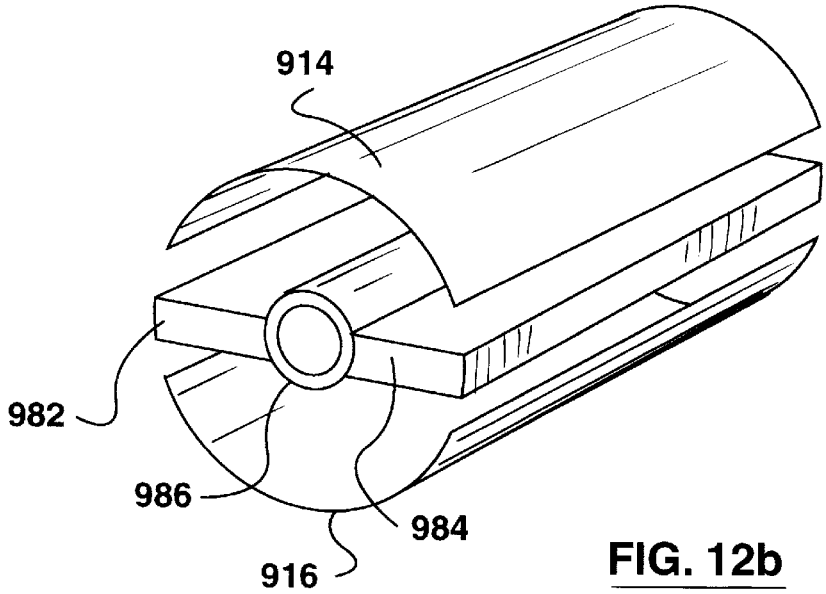
FIG. 12*b* is a perspective view of a portion of FIG. 12*a,*

FIGS. 12*a* and 12*b* illustrate a lamp 900 where curved electrodes 914, 916 are contained within a dielectric tube 970 and separated by dielectric slabs 982, 984. The electrodes are formed of spring steel or other resilient metal so as to resiliently hug the inner wall of tube 970. Cooling fluid may be injected through an inner dielectric tube 986 and returned through the annulus between tubes 970 and 986. Gas is contained within a chamber 912 between dielectric tube 970 and outer tube 988. When the AC source 924 to which the electrodes are connected is energised, the electrodes create an electric field in chamber 912 which breaks down the gas.

The advantage of lamp 900 is that the central portion 990 of the lamp comprising tube 970 and everything interior of tube 970 may be made separately from outer tube 988. This facilitates manufacture of lamp 900. Also, with the electrodes hugging the interior wall of tube 970, the path from one electrode, through the gas, to the other electrode is as short as possible. This maximizes the electric field strength for the lamp.

Figure 13:
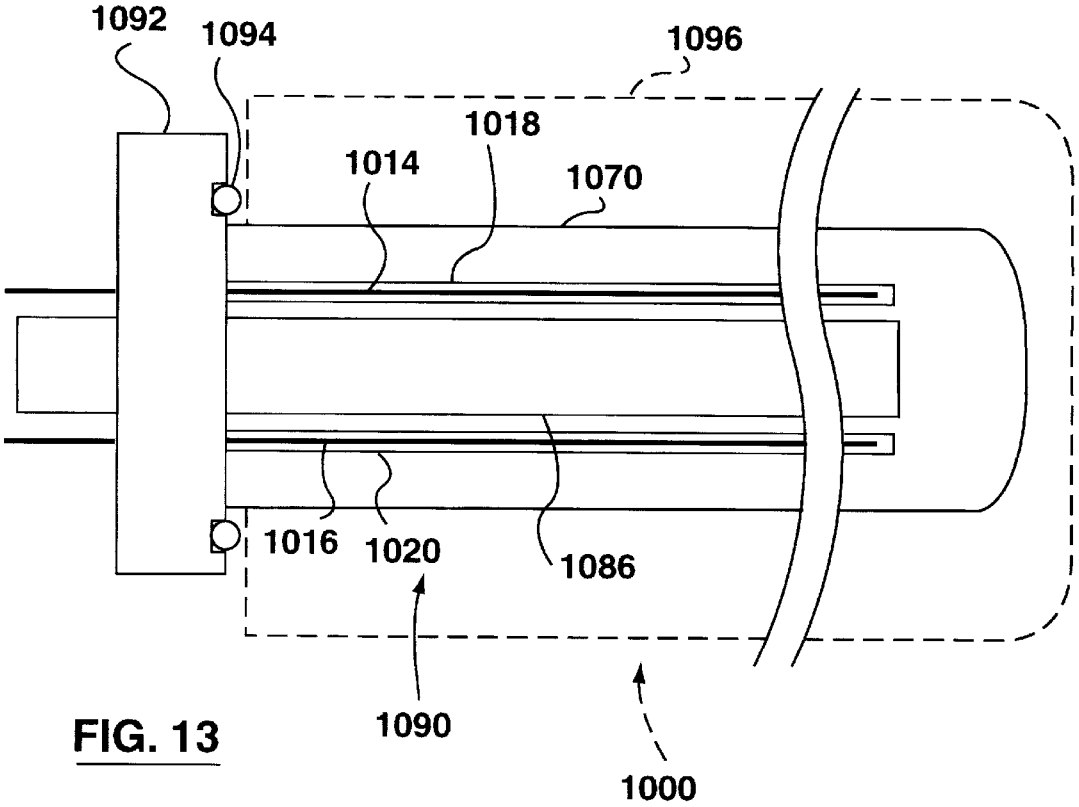
FIG. 13 is a schematic side view of a lamp made in accordance with another aspect of this invention.

FIG. 13 illustrates a central portion 1090 for a lamp 1000. Electrodes 1014, 1016 are contained within dielectric tubes 1018, 1020, respectively. Tubes 1018, 1020 surround an inner tube 1086 (which may be dielectric or non-dielectric) through which cooling fluid may be injected. This structure is surrounded by a non-dielectric tube 1070 such that cooling fluid injected in tube 1086 may be returned through the annulus between tubes 1070 and 1086. A bridge 1092 joins tubes 1018, 1020, and 1086 and has a gasket 1094. An outer lamp body shown in ghost at 1096 may be positioned around tube 1070 of central portion 1090 and sealed against the gasket of bridge 1092 after gas is introduced into the body 1096. An AC source may then be connected between the electrodes. Advantageously, this lamp is modified to include additional electrodes (with adjacent electrodes connected to opposite poles of the AC source.

Figure 14:
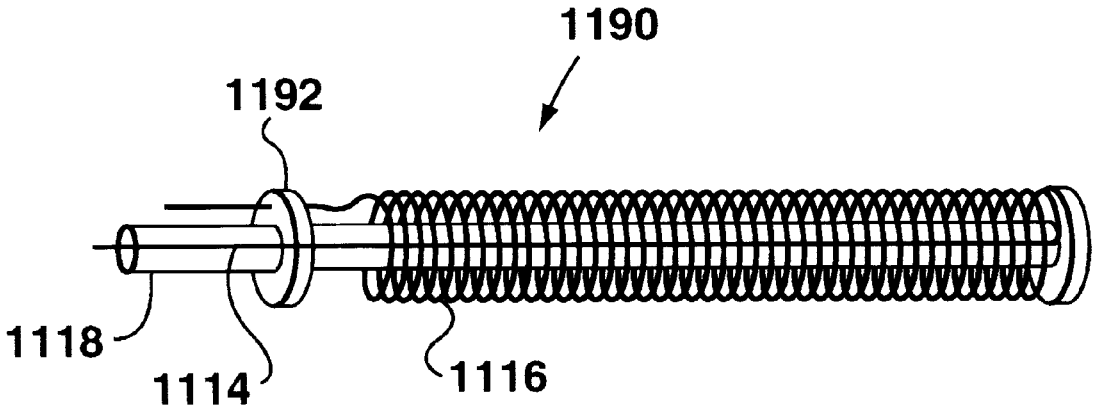
FIG. 14 is a perspective view of a central portion of a lamp made in accordance with another aspect of this invention.

FIG. 14 illustrates a part of another central portion 1190 for a lamp. Referencing FIG. 14, a first electrode 1114 is disposed within a dielectric tube 1118. A second helical electrode 1116 is disposed within a dielectric helical tube (not shown). The electrodes are surrounded by a non-dielectric tube (not shown) joined to abutment 1192 to complete the central portion. The central portion may be received in a gas filled outer lamp body and an AC source applied between the electrodes.

Figure 15:
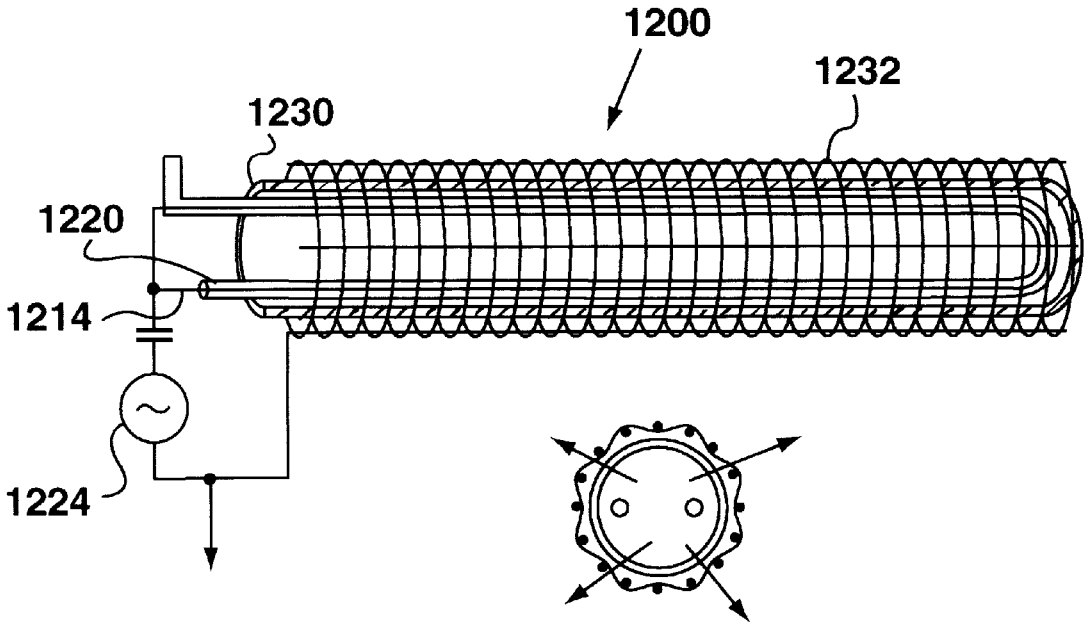
FIG. 15 is a partially schematic and partially perspective view of a lamp made in accordance with another aspect of this invention.

While the preferred lamp constructions avoid an exterior electrode, lamp constructions with such an electrode may be improved in accordance with this invention. Referencing FIG. 15, a lamp 1200 has a U-shaped inner electrode 1214 disposed within U-shaped dielectric tube 1220. Tube 1220 is received within (dielectric or non-dielectric) lamp body 1230 which is filled with gas. An electrode grid 1232 surrounds the lamp body 1230. The electrode grid is connected to one pole of AC source 1224 and the U-shaped electrode is connected to the other pole of the AC source. Cooling fluid is injected through port 1270 in one leg of U-shaped tube 1220 and returned through the other leg of the U-shaped tube. With this arrangement, one end of the lamp body 1230 can be closed thereby simplifying manufacture and reducing the likelihood of gas leaks.

Lamps with an exterior electrode may also be constructed with a separate central portion, as previously described in conjunction with the lamps of FIGS. 12*a*, 12*b*, 13, and 14.

Any of the lamps which emit about their periphery may be surrounded by a jacket with an inlet and outlet so as to form an annular treatment chamber about the lamp.

Figure 16A:
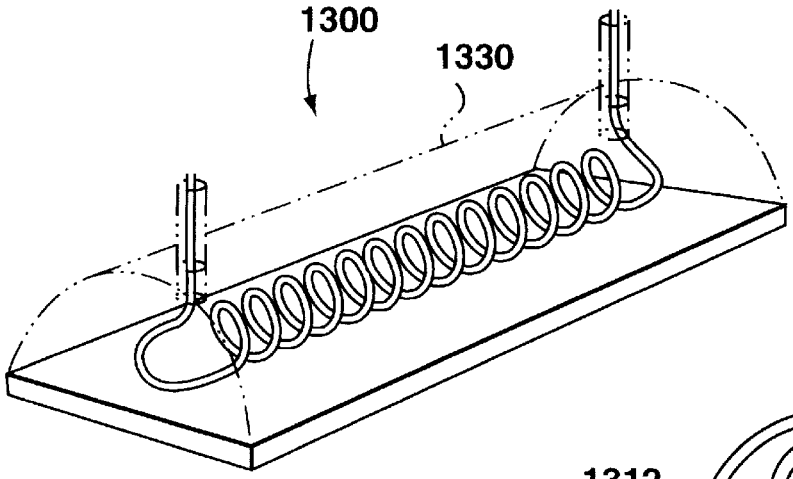
FIG. 16*a* is a perspective view of a portion of a lamp made in accordance with another aspect of this invention.
Figure 16B:
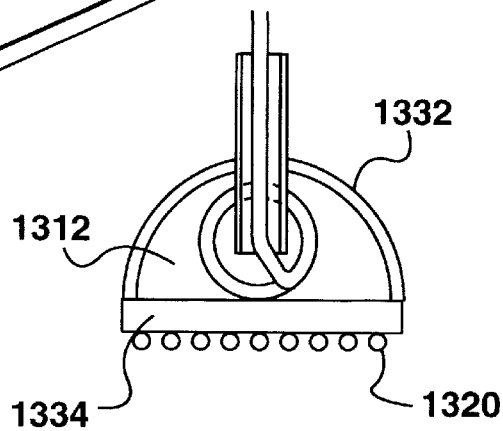
FIG. 16*b* is an end view of FIG. 16*a,*

FIGS. 16*a*, 16*b* illustrate a lamp 1300 with a dielectric helical tube 1320 with an inside surface coated with an electrode film 1314. The lamp body 1330 has a half-circular cross-section with a reflective mirrored upper curved section 1332 and a flat base section 1334. A grid electrode 1320 is disposed below the base section 1334. Gas is contained within the chamber 1312 of the lamp body 1330. An AC source is connected between the two electrodes. The helical electrode film 1314 assists in reducing ion bombardment of the lamp body 1330 thereby prolonging lamp life.

Figure 17:
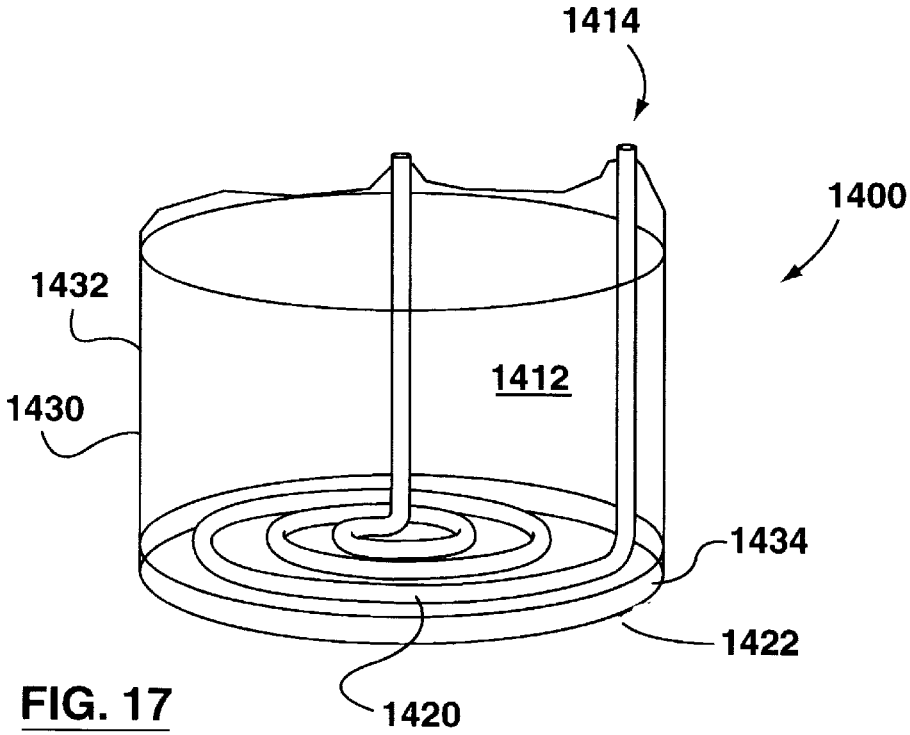
FIG. 17 is a schematic view of a lamp made in accordance with another aspect of this invention.

FIG. 17 illustrates a lamp 1400 with a dielectric spiral tube 1420 with an inside surface coated with an electrode film 1414. The lamp body 1430 has a cylindrical upper section 1432 and a flat base section 1434. A grid electrode 1422 is disposed below the base section 1434. Gas is contained within the chamber 1412 of the lamp body 1430. An AC source is connected between the two electrodes. The spiral electrode film 1414 assists in reducing ion bombardment of the lamp body 1430 thereby prolonging lamp life.

Figures 18A, 18B:
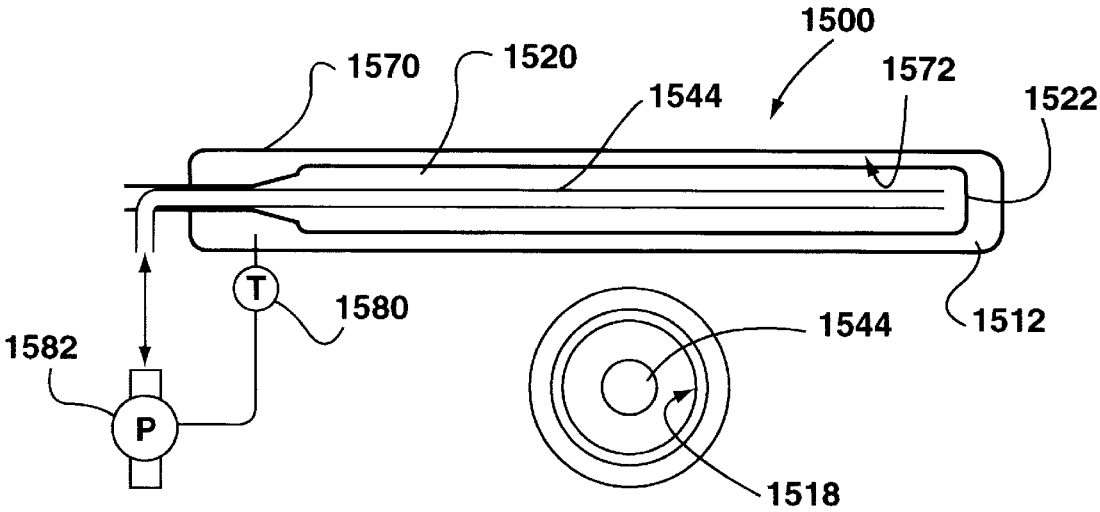
FIG. 18*a* is a schematic side view of a lamp made in accordance with another aspect of this invention.
FIG. 18*b* is an end view of the lamp of FIG. 18*a*.

FIGS. 18*a*, 18*b* illustrate a lamp 1500 with an enlarged dielectric tube 1520 coated interiorly with an electrode film 1518. The enlarged tube has a blind end 1522. A lamp body 1570 surrounds the dielectric tube and an electrode grid (not shown) surrounds the lamp body. A cooling tube 1544 is co-axially received in the dielectric tube and terminates proximate blind end 1522. Gas is received in the lamp between the lamp body and the enlarged tube. The enlarged tube 1520 reduces the radial distance between the two electrodes. Since the electric field between these electrodes is an inverse function of their spacing, when an AC source is connected between the electrodes, a larger electric field is generated than would be were tube 1520 not enlarged. A similar effect may be achieved if tube 1520 is not enlarged but is mounted eccentrically in lamp body 1570.

As shown in FIG. 18*a*, a temperature sensor 1580 senses the temperature in the gas chamber 1512. An output from the temperature sensor feeds to a control input of variable speed cooling fluid pump 1582 so that the flow speed of the cooling fluid in the lamp is directly proportional to the temperature in the gas chamber. This same arrangement may be employed with any other of the described lamps.

The radiance of any of the lamps may be increased by coating the interior of the outermost wall of the lamp with a phosphor. For example, the interior of wall 1570 may have a phosphorescent coating 1572.

If one of the described lamps is to emit in the UV range, then example gas fills for the lamp are as follows:

| | UV emmision wavelength in nm |
|---|---|
| Neon + Fluorine | 106 |
| Xenon | 171 |
| Xenon + Helium | 171 |
| Xenon + Helium + Neon | 171 |
| Argon | 104,106,130 |
| Argon + Chlorine | 175,195 |
| Argon + fluorine | 185,193,204,4 |
| Argon + Bromine | 165,172,183 |
| Argon + Iodine | |
| Krypton | 140,124,165 |
| Krypton + Chlorine | 220,222,240,235,260 |
| Krypton + Fluorine | 249 |
| Krypton + Bromine | 207,222,208 |
| Krypton + Iodine | 190,195,225 |
| Xenon + Chlorine | 236,308,345,340 |
| Xenon + Fluorine | 264,251,460,410 |
| Xenon + Bromine | 221,282,300,325 |
| Xenon + Iodine | 203,252,265,320 |
| Helium + Mercury | 184,254 |
| Neon + Mercury | 184,254 |
| Argon + Mercury | 184,254 |
| Krypton + Mercury | 184,254 |
| Xenon + Mercury | 184,254 |

Other modifications within the spirit of the invention will be apparent to those skilled in the art.

What is claimed is:

1. An electrodeless lamp, comprising:

a gas containing chamber;

a first electrode within said gas chamber;

a second electrode within said gas chamber;

a dielectric barrier separating said first electrode from said second electrode;

an AC source coupled between said first and second electrodes;

said dielectric barrier comprising a first tube surrounding said first electrode and a second tube surrounding said second electrode extending beside said first tube, said first tube and said second tube being joined at one end by a U-shaped section.

2. The electrodeless lamp of claim 1 including a third electrode surrounded by a dielectric and a fourth electrode surrounded by a dielectric and wherein said AC source is also coupled between said third electrode and said fourth electrode.

3. The electrodeless lamp of claim 1 wherein said first electrode comprises a conductive coating on an inside wall of said first tube and wherein said second electrode comprises a conductive coating on an inside wall of said second tube.

4. The electrodeless lamp of claim 1 including a phosphorous coating on an inside wall of said gas containing chamber.

5. The electrodeless lamp of claim 1 including a mirror disposed outside said gas containing chamber arranged for concentrating light emitted from said gas containing chamber.

6. An electrodeless lamp, comprising:

a gas containing chamber;

a first electrode within said gas chamber;

a second electrode within said gas chamber;

a dielectric barrier separating said first electrode from said second electrode;

an AC source coupled between said first and second electrodes;

said dielectric barrier comprising a first tube surrounding said first electrode and a second tube surrounding said second electrode extending beside said first tube; and a bridge joining said first tube and second tube thereby forming a structure and wherein said gas chamber has an exterior wall sealed about at least a portion of said structure.

7. The electrodeless lamp of claim 6 wherein said structure includes a resilient member for sealingly bearing against said chamber exterior wall.

8. An electrodeless lamp, comprising:

a gas containing chamber;

a first electrode within said gas chamber;

a second electrode within said gas chamber;

a dielectric barrier separating said first electrode from said second electrode;

an AC source coupled between said first and second electrodes;

said dielectric barrier comprising a first tube surrounding said first electrode; and a variable speed pump for pumping cooling fluid through said tube.

9. The electrodeless lamp of claim 8 including a temperature sensor associated with said gas chamber and wherein a speed control of said pump is responsive to said temperature sensor.

10. The electrodeless lamp of claim 1 wherein said first electrode is helically wound about said second electrode.

11. An electrodeless lamp, comprising:

a gas containing chamber having a dielectric chamber wall a first electrode extending along said dielectric chamber wall outside of said gas containing chamber;

a wound second electrode within said gas chamber surrounded by a dielectric tube;

an AC source coupled between said first and second electrodes and;

a variable speed pump for pumping cooling fluid through said tube.

12. The electrodeless lamp of claim 11 wherein said first electrode comprises a conductive coating on said dielectric chamber wall.

13. The electrodeless lamp of claim 12 wherein said chamber wall conductive coating is patterned on said chamber wall.

14. The electrodeless lamp of claim 12 wherein said chamber wall conductive coating is transparent to UV light.

15. The electrodeless lamp of claim 11 wherein said second electrode is helically wound.

16. The electrodeless lamp of claim 11 wherein said second electrode is spirally wound.

17. The electrodeless lamp of claim 11 including a temperature sensor associated with said gas chamber and wherein a speed control of said pump is responsive to said temperature sensor.

18. An electrodeless lamp, comprising:

a gas containing chamber;

a plurality of first electrodes extending into said gas chamber from one end of said gas chamber;

a like plurality of first dielectric tubes extending into said gas chamber from said one end, each first dielectric tube surrounding one first electrode such that each first electrode is surrounded by one first dielectric tube;

at least one second electrode extending into said gas chamber from said one end, each said at least one second electrode surrounded by a second dielectric tube extending into said gas chamber from said one end;

said first electrodes for coupling with said at least one second electrode across an AC source;

each of said first and second tubes in fluid communication with at least one other of said first and second tubes proximate an end of said gas containing chamber opposite said one end to form a tube set such that cooling fluid may be pumped into one tube of each tube set and returned from remaining tubes of said each tube set.

19. The electrodeless lamp of claim 18 wherein there is only one tube set.

20. The electrodeless lamp of claim 19 wherein there is only one second electrode and wherein said plurality of first electrodes are disposed circumferentially about said second electrode.

21. The electrodeless lamp of claim 18 further comprising means to port cooling fluid into said one tube of each tube set.

* * * * *